US005738435A

United States Patent [19]

Lin et al.

[11] Patent Number: 5,738,435

[45] Date of Patent: Apr. 14, 1998

[54] WATERPROOF LAMPHOLDER

[76] Inventors: Mei-Mei Lin; Li-Wen Liu, both of P.O. Box 55-175, Taichung, Taiwan

[21] Appl. No.: 711,634

[22] Filed: Sep. 9, 1996

[51] Int. Cl.[6] ..... F21V 21/00; H01R 4/24

[52] U.S. Cl. ..... 362/249; 362/806; 362/391; 362/267; 439/419

[58] Field of Search ..... 362/249, 806, 362/123, 391, 267, 226; 439/419, 414, 658

[56] References Cited

U.S. PATENT DOCUMENTS

| | | | |
|---|---|---|---|
| 4,777,573 | 10/1988 | Liao | 362/249 |
| 5,366,386 | 11/1994 | Liao | 439/419 |
| 5,542,858 | 8/1996 | Liao | 439/419 |
| 5,547,392 | 8/1996 | Cheng et al. | 439/419 |
| 5,552,348 | 9/1996 | Wu | 439/419 |

*Primary Examiner*—Thomas M. Sember

[57] ABSTRACT

A waterproof lampholder is provided. The lampholder comprises a lamp receptacle and a cap member. An annular extension is formed at an internal wall and adjacent a trumpet opening of the lamp recceptacle engageable with an outer periphery of a bulb for preventing external water from permeating into the forward end of the lampholder. An inverse V-shaped annular projection is in the bottom of the lamp receptacle aligned with a V-shaped annular groove formed in the inward surface of the cap member for preventing external water from permeating into the rearward end of the lamp receptacle. A pair of slotted projections on the cap member is aligned with a pair of M-shaped slots in the bottom of the lamp receptacle to define a pair of juxtaposed circular spaces for receiving a two-ply electrical cable which also provides waterproof function. Upon this arrangement, the present invention will no longer be causing an short circuit or an electric shock while raining or using a sprinkle in a yard.

1 Claim, 2 Drawing Sheets

WATERPROOF LAMPHOLDER

BACKGROUND OF THE INVENTION

The present invention relates to lampholders for incandescent lights, and more particularly to a waterproof lampholder which includes a lamp receptacle and a cap member both having a waterproof structure to prevent external water from permeating into the lampholder so that the lamp cannot cause an electric shock or a short circuit.

Christmas lights are mostly decorated outdoors, therefore a waterproof lampholder for preventing external water from permiating into the lampholder is very important. Prior art lampholders leave a gap between the lamp receptacle and the bulb or between the lamp receptacle and the cap member thus permitting the water to permeate into the lampholder. When it is raining or a sprinkler is positioned nearby, the water will permeate into the lampholder via the gaps, therefore causing a short circuit while electric power is conducting or an electric shock when people touch it.

SUMMARY OF THE PRESENT INVENTION

The main object of the present invention is to provide a waterproof lampholder which a lamp receptacle has an annular extension integral with an inner periphery adjacent the trumpet opening and engageable with the outer periphery of a bulb in order to prevent water from permeating into the forward end of the lampholder.

Another object of the present invention is to provide an inverse V-shaped annular projection on the outer surface of the bottom of the lamp receptacle engageable with a V-shaped annular groove formed on an upper surface of the cap member in order to prevent water from permeating into the rearward end of the lampholder.

The present invention will become more fully understood by reference to the following detailed description thereof when read in conjunction with the attached drawings.

DETAILED DESCRIPTION OF THE PREFERRED EMBODIMENT

Figures 1, 1A, 1B, 1C:
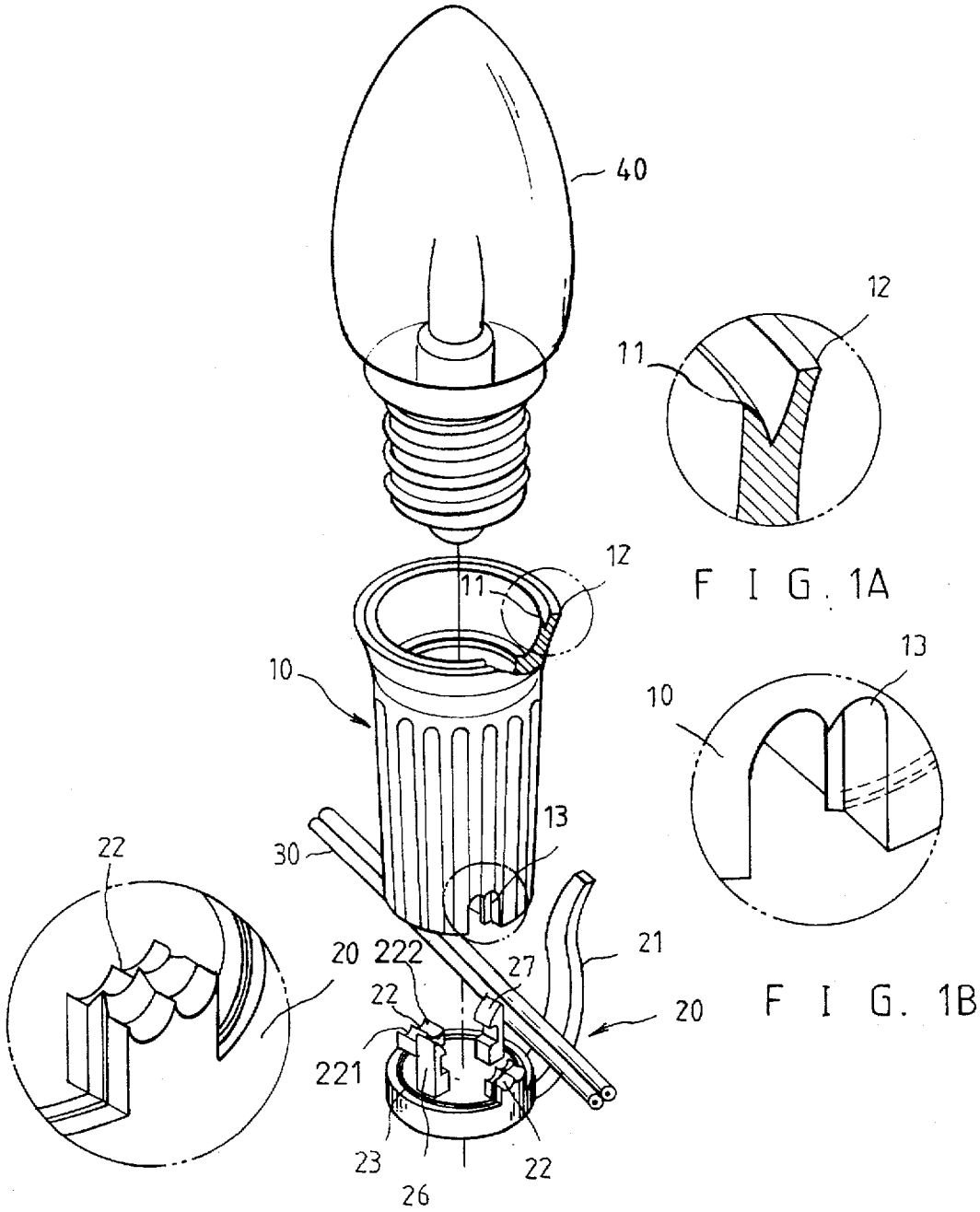
FIG. 1 is an exploded perspective view to show the preferred embodiment of the present invention.
FIG. 1A is a sectional view to show an annular extension in a trumpet opening of the lamp receptacle.
FIG. 1B is a perspective view to show a M-shaped slot formed in a circumferential wall of the lamp receptacle.
FIG. 1C is a perspective view to show a slotted projection projected upward from a circumference of the cap member.
Figure 2:
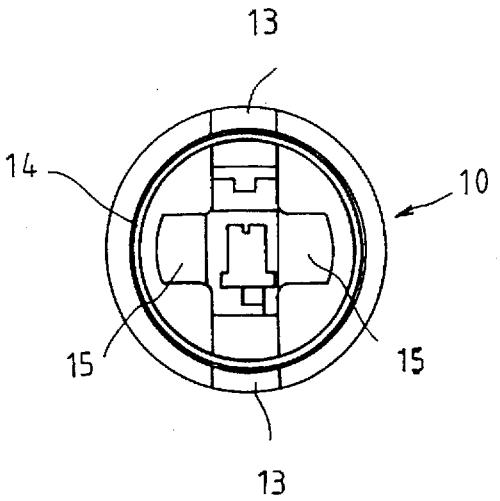
FIG. 2 is a bottom view to show the details in the bottom of the lamp receptacle according to the present invention.
Figure 3:
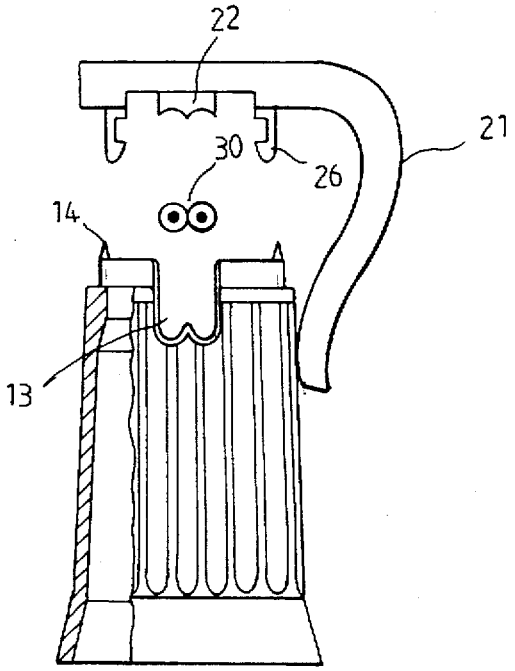
FIG. 3 is a perspective view to show the assembly of the cap member onto the lamp receptacle.

With reference to FIGS. 1 to 3 of the drawings, the present invention a waterproof lampholder generally comprises a lamp receptacle 10 and a cap 20. The lamp receptacle 10 has a hollow cylinder housing including a bottom and a trumpet opening, an annular extension 11 extending from a sloped internal wall adjacent the rim of the opening, the annular extension 11 is flexible and stops against the outer periphery of the bulb 40 when it mounts into the lamp receptacle 10 so as to prevent external water from permeating into the lampholder, an inverse V-shaped annular projection 14 formed around the outer surface of the bottom of the lamp receptacle 10 and adjacent the circumferential edge (as shown in FIGS. 2 and 3), a pair of roughly M-shaped slots 13 including a pair of juxtaposed recesses therein for receiving a two-ply electrical cable 30 symmetrically formed in the opposite circumferential walls of the bottom, and a pair of rectangular cavities 15 symmetrically formed in the bottom perpendicular to the slots 13.

The cap member 20 has a circular body, a hook 21 obliguely extending outward from a circumferential edge of the body, a pair of slotted projections 22 symmetrically projectd upward from the opposite circumferential edges of the bottom, each having a pair of juxtaposed semi-circular slots 221 and 222 engageable with the pair of M-shaped slots 13 in order to define a pair of circular spaces for receiving a pair of electrical cables therein. A pair of V-shaped annular grooves 23 are formed on the planar surface of the cap member 20 engageable with inverse V-shaped annular projection 14, and a pair of hook members 26 and 27 being symmetrically projected upward from an opposing circumferential edges of the cap member 20 perpendicular to the slotted projections 22 and engageable with the cavities 15 of the Iamp receptacle 10.

When assembled, the lamp receptacle 10 is axially engagd with the cap member 20 with a two-ply electrical cable 38 disposed therebetween, wherein the inverse V-shaped annular projection 14 engages with the V-shaped groove 23, the pair of the slotted projections 22 engage into the M-shaped slots 13, and a bulb 40 mounts into the lamp receptacle 10, so that the annular extension 11 will grip and stop against the outer periphery of the bulb 40. Accordingly, the lampholder of the present invention will prevent external water from permeating into either ends of the lampholder.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

We claim:

1. A waterproof lampholder comprising:

a lamp receptacle having a hollow cylinder body with a bottom and a trumpet opening, an annular extension obliguely projected from an internal wall, a pair of roughly M-shaped slots symmetrically formed in opposing circumferential walls of the bottom, an annular protrudent projection of inverse V-shaped section projected from an outer surface of the bottom and a pair of cavities symmetrically formed in the bottom perpendicular to the M-shaped slots which have a pair of semi-circular recesses juxtaposed therein;

a cap member axially engaged in the bottom of said lamp receptacle, said member having a pair of slotted projection symmetrically projected upward from opposing circumferential edges aligned with the M-shaped slots, an annular groove of a V-shaped section formed in an upper surface of the cap member engageable with the inverse V-shaped annular projection, and a pair of hook members symmetrically formed on the bottom of said cap member perpendicular to the slotted projections and engageable within the cavities in the bottom of said lamp receptacle thereof.

* * * * *